US006176729B1

(12) United States Patent
Myers

(10) Patent No.: US 6,176,729 B1
(45) Date of Patent: Jan. 23, 2001

(54) CORD-TO-CORD RESTRAINING DEVICE

(76) Inventor: Harold R. Myers, 4701 Chastant St., Metairie, LA (US) 70056

( * ) Notice: Under 35 U.S.C. 154(b), the term of this patent shall be extended for 0 days.

(21) Appl. No.: 09/580,762

(22) Filed: May 30, 2000

(51) Int. Cl.[7] ..... H01R 13/62
(52) U.S. Cl. ..... 439/369; 439/370
(58) Field of Search ..... 439/369, 368, 439/370, 371, 484, 345

(56) References Cited

U.S. PATENT DOCUMENTS

| | | | | |
|---|---|---|---|---|
| 3,781,761 | | 12/1973 | Harwood . | |
| 4,504,106 | | 3/1985 | Fechter . | |
| 4,610,494 | | 9/1986 | Schauber . | |
| 4,773,874 | * | 9/1988 | Kopeski, Jr. | 439/369 |
| 5,255,866 | | 10/1993 | Campolo . | |
| 5,334,042 | * | 8/1994 | Chevalier | 439/369 |
| 5,423,693 | * | 6/1995 | Light | 439/369 |
| 5,514,004 | | 5/1996 | Swanson . | |
| 5,549,482 | | 8/1996 | Langlais et al. . | |
| 5,582,524 | | 12/1996 | Sanner et al. . | |
| 5,628,646 | * | 5/1997 | Voss | 439/369 |
| 5,752,848 | * | 5/1998 | Youngmark | 439/371 |

FOREIGN PATENT DOCUMENTS 3343-233 5/1985 (DE) .

* cited by examiner

*Primary Examiner*—Paula Bradley
*Assistant Examiner*—Tho D. Ta
(74) *Attorney, Agent, or Firm*—Shawn David Sentilles

(57) ABSTRACT

A cord-to-cord restraining device for maintaining electrical cords and the like in plugged together electrical connection comprising a base member, a clip, an eyelet, and a hook. The base member has a front end, a rear end, a top side, and a bottom side. The clip is on the bottom side of the base member, and is configured to engage and secure the device on a first electrical cord. The eyelet is on the top side of the base member closer to the front end than the rear end. The eyelet defines an opening sized to receive a loop of a second electrical cord. The hook member is on the top side of the base member closer to the rear end than the front end, and is configured to receive the loop of the second electrical cord and secure the second electrical cord on the base member. Methods of using the device are also provided.

14 Claims, 3 Drawing Sheets

CORD-TO-CORD RESTRAINING DEVICE

FIELD OF INVENTION

The present invention relates to electrically powered tools, and more particularly to cord-to-cord restraining devices for securing electrical cords and the like to one another.

BACKGROUND OF THE INVENTION

Many electrically powered tools operate via ordinary household AC current, and therefore must be plugged into an electrical wall outlet during operation. AC wall current has been used for many years to operate tools such as radial saws, drills, routers, sanders, and the like. Additionally, in recent years AC current has begun to be used widely on outdoor lawn tools that formerly were gasoline powered, such as lawnmowers, tree trimmers, chainsaws, weed eaters, and the like. Electrically powered tools are typically provided with a built-in electrical cord that extends from the body or handle of the tool. The built-in cord may vary in length from anywhere from two inches (a "pigtail" cord) to upwards of twenty feet and more. The built-in cord ends in a standard male plug that can be plugged into either a wall outlet or an extension cord. When an extension cord is used, the male plug of the built-in cord is plugged into the female socket of the extension cord, while the male plug of the extension cord is plugged into a wall outlet.

The present invention is directed to the problem of separation of power cords without relying on friction between the metal conductors of the plugs to maintain the connection. The contact pressure (friction) of the metal parts of conventional plugs is designed for nothing more than adequate pressure to maintain electrical integrity between the two cords. Separation occurs frequently when a built-in cord of an electrical tool is plugged into an extension cord, and also when two electrical cords are plugged together. The problem of cord separation occurs with ordinary workshop power tools, but is particularly widespread with the use of power lawn tools, which are typically carried about the yard during operation. Because lawn tools are typically used large distances from the wall outlet, a portion of the extension cord can easily become snagged around or under a tree, fence, lawn furniture or the like. When this occurs and sufficient tension develops in the plug connection, such as where the operator of the tool does not notice that the cord has become snagged or the operator has reached the limit of the length of the cord, the end of the built in cord separates from the female end of the extension cord. This can result in dangerous situations. For example, the cords may momentarily separate, breaking the electrical connection and causing the tool to shut off, but then, upon release of tension on the cords, reestablish electrical connection, causing the tool to start up again.

A number of devices have been constructed for holding and securing electrical cords together. Most users of electrical tools are familiar with the method of tying or intertwining the ends of two electrical cords together and then plugging the ends of the cords together. When tied together in this manner, strain or tension that develops in the cords is borne by the knot holding the cords together, such that the cords cannot separate. One disadvantage of this method is that it can cause damage to the outer insulation of the cords, most likely at the end attachments of the cords, i.e. the cords, particularly over the course of time. Additionally, it is sometimes difficult to separate the knot.

As shown in FIG. 1, the prior art includes a restraining device built into the handle 100 of an electrically powered tool. This embodiment includes an eyelet member 102 and a hook member 104 that extend downward from the handle 100 of the tool. As shown in FIG. 1, a folded portion of an extension cord is passed through the eyelet 102 and then looped over the hook 104. A female end 95 of an extension cord 90 is then plugged into a male plug 82 of the tool 100. A fundamental disadvantage of the prior art embodiment of FIG. 1 is that if the hook member 104 or the eyelet member 102 breaks, the device can no longer be used to hold a cord onto the device. The built-in holding device becomes useless for its intended purpose, and cannot be replaced. The disadvantage of this design is further heightened by the fact that remnant pieces of the broken components cannot be readily removed from the handle of the tool, and thus become potential hazards. The broken remnants may catch on clothing or other items, which can be particularly dangerous with powerful electric tools such as chainsaws and tree trimmers. Additionally, because the built-in restraining device cannot be transferred to other electrical cords, it serves only to hold a cord onto the particular power tool that has the built-in restraining device.

A number of devices have been devised for restraining electrical cords. Most such devices provide an elongated or bar-like member having at least two symmetric cord holders spaced apart along the elongated member. See U.S. Pat. No. 3,781,761 (Harwood), U.S. Pat. No. 4,504,106 (Fechter), U.S. Pat. No. 5,255,866 (Campolo), U.S. Pat. No. 5,514,004 (Swanson), and U.S. Pat. No. 5,549,482 (Langlais et al). One disadvantage of such devices is that they require each cord to be pulled tight around a respective cord holder, which can cause damage to the outer insulation of both cords. Because each cord must be bent around its respective cord holder, an unnecessary amount of crimping and bending of cords is required. Additionally, it becomes difficult to unplug the cords when on the device. Another disadvantage of such devices is that they are not configured to remain in place on one of the cords once the electrical cords are separated. Once separated from the cord, the device can easily become misplaced. Additionally, because such devices have symmetrical holders on either end of an elongated member, they tend to be bulky. Finally, an important disadvantage of such designs is that they cannot be used with short cords, such as the pig-tail cords found on many power tools.

U.S. Pat. No. 5,582,524 (Sanner et al) discloses a cord-to-cord restraining device comprising an elongated base having a first end and a second end, a first eyelet secured to the base member closer to the first end, and a second eyelet secured closer to the second end. The eyelets are sized for receiving loops of electrical cords. First and second hook members are secured to the base between the two eyelets. A looped portion of a first electrical cord is passed through one eyelet and looped over a corresponding hook member, while a looped portion of a second electrical cord is passed through the other eyelet and looped over the other hook member. The Sanner design suffers from the above mentioned disadvantages.

Other configurations have been used as cord-to-cord restraining devices. U.S. Pat. No. 4,610,494 (Schauber) discloses a flexible loop through which the two cords can be passed. The Schauber device requires a fairly large loop, because the plugs of each cord must pass through the loop. German Patent DE 3343233 (Bosch) discloses a retaining lug formed or built into the end of a plug connector and having two profiled hooks for engaging an electrical cord.

There is thus a need for a cord-to-cord restraining device that overcomes the foregoing problems and shortcomings of the prior art.

OBJECTS AND SUMMARY OF THE INVENTION

It is an object of the invention to provide a cord-to-cord restraining device for securing electrical cords to one another.

It is another object of the invention to provide a cord-to-cord restraining device that can be used on short cords, such as the short pig-tail cords that are built into power tools.

It is another object of the invention to provide a cord-to-cord restraining device that can be readily removed to thereby allow selective separation of cords.

It is another object of the invention to provide a cord-to-cord restraining device that can be readily removed and reused on multiple electrically powered tools or electrical cords.

It is another object of the invention to provide a cord-to-cord restraining device that can be stored on an extension cord, and therefore will be less likely to become lost or damaged.

It is another object of the invention to provide a cord-to-cord restraining device that reduces damage to the outer insulation of electrical cords by eliminating reducing bending and crimping of cords.

It is another object of the invention to provide a cord-to-cord restraining device in which the cords can be readily disconnected as desired while still attached to the device.

It is yet another object of the invention to provide a cord-to-cord restraining device that is smaller and more compact than existing devices, and therefore less expensive to manufacture and easier to package and store.

These and other objects and advantages of the invention shall become apparent from the following general and preferred description of the invention.

Accordingly, a cord-to-cord restraining device for maintaining electrical cords and the like in plugged together electrical connection is provided comprising a base member, a clip, an eyelet, and a hook. The base member has a front end, a rear end, a top side, and a bottom side. The clip is on the bottom side of the base member, and is configured to engage and secure the device on a first electrical cord. The eyelet is on the top side of the base member closer to the front end than the rear end. The eyelet defines an opening sized to receive a loop of a second electrical cord. The hook member is on the top side of the base member closer to the rear end than the front end, and is configured to receive the loop of the second electrical cord and secure the second electrical cord on the base member.

The clip preferably comprises a pair of opposing elastic arm members or straps extending downward from the bottom side of the base member. A lower end of each arm member preferably converges toward the lower end of the opposing arm member, the lower ends of the arm members being spaced apart from one another a distance less than a diameter of the first electrical cord. Each arm member is preferably substantially semicircular, such that an inner side of each the arm member abuts against an outer surface of the first electrical cord to thereby prevent the device from sliding along the first electrical cord. In a preferred embodiment, the clip is substantially centrally disposed on the bottom side of the base member. The hook member preferably comprises an upward extension extending upward from the top side of the base member, and a rearward extension extending toward the rear end of the base member. The device is preferably molded as one piece from plastic. Methods of using the device are also provided.

PREFERRED EMBODIMENTS OF THE INVENTION

Figure 1:
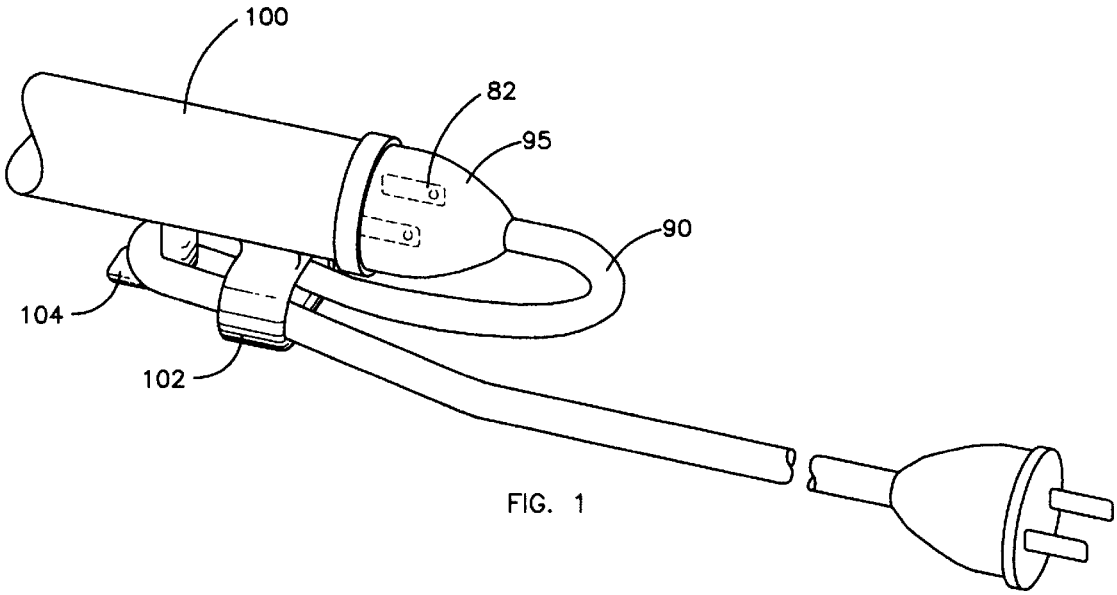
FIG. 1 is a side perspective view of a prior art device that incorporates a built-in cord restraining device.
Figure 2:
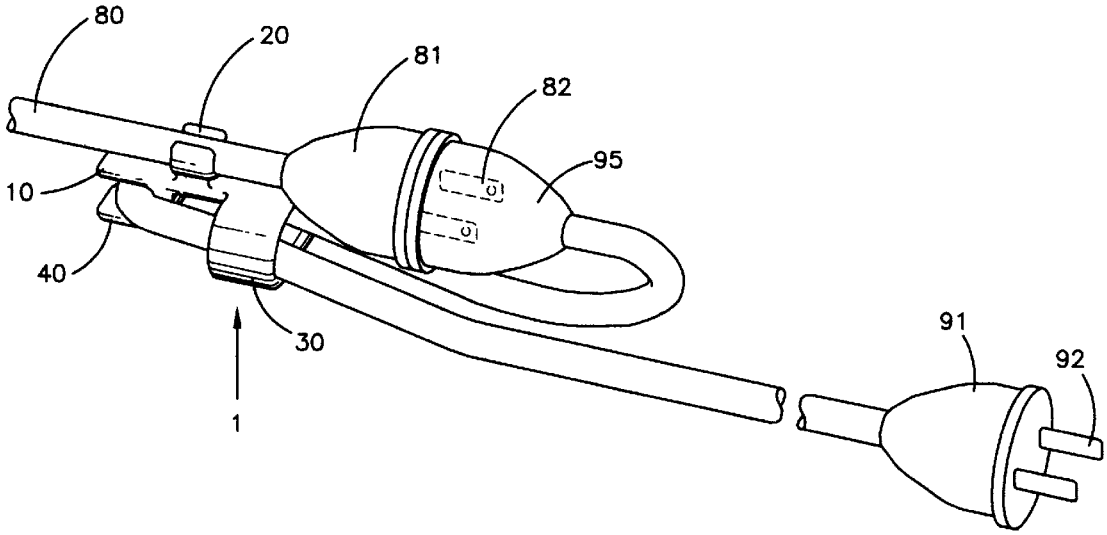
FIG. 2 is a side perspective view of one preferred embodiment of the invention showing the device restraining a pair of connected electrical cords.

As shown in FIG. 2, the cord-to-cord restraining device of the invention 1 comprises generally a base member 10, a clip 20, an eyelet 30, and a hook member 40. The base member 10 is preferably elongated. As shown most clearly in FIG. 5, the base member 10 has a bottom side 12, a top side 14, a front end 16, and a rear end 18. The use of positional terms is relative with regard to this invention. When used to secure electrical cords, the device 1 will assume various orientations, whether by choice of the operator or by ordinary twisting and rotating of the electrical cords during use. For example, FIG. 1 shows an orientation in which the bottom side 12 of the base member 10 is oriented on top, i.e. above the top side 14 of the base member 10. Accordingly, the use of positional terms herein is for description purposes only, and is not intended to limit the scope of the claims.

Figure 4:
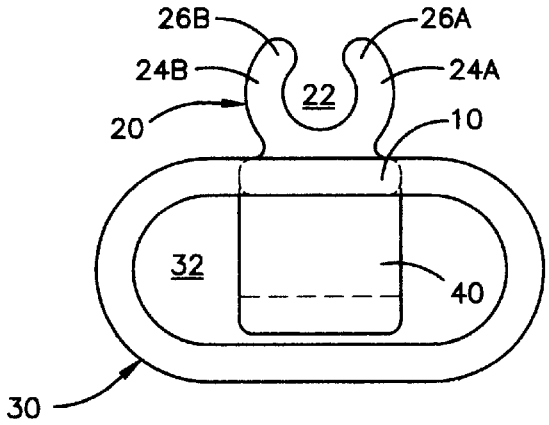
FIG. 4 is a front view of one preferred embodiment of the invention, with phantom lines indicating certain contours of the device.
Figure 5:
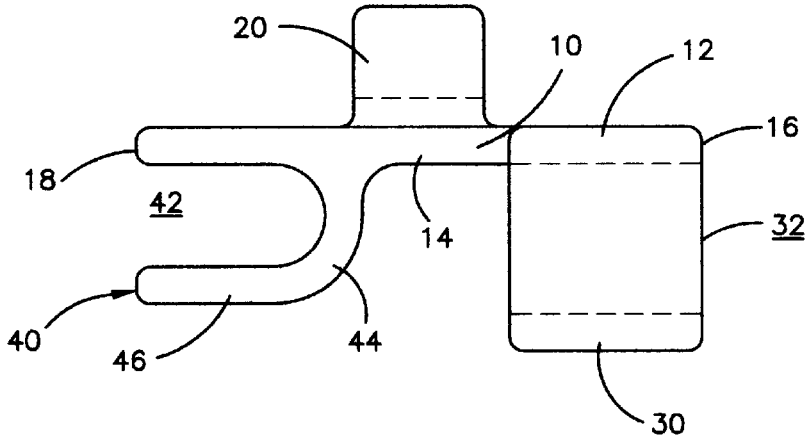
FIG. 5 is a side view of one preferred embodiment of the invention, with phantom lines indicating certain contours of the device.
Figure 6:
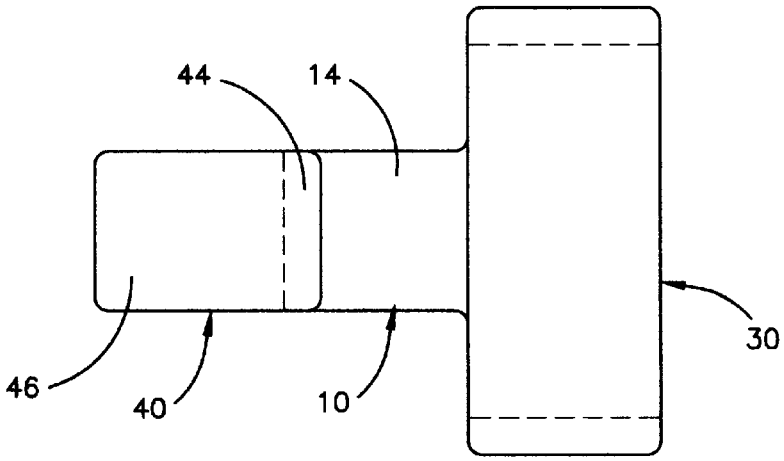
FIG. 6 is a top view of one preferred embodiment of the invention, with phantom lines indicating certain contours of the device.

The clip 20 is on the bottom side 12 of the base member 10, i.e. substantially on an opposite side of the base member 10 from the eyelet member 30 and hook member 40. The clip 20 is configured to engage and secure the device on a first electrical cord 80, as shown most clearly in FIG. 2. The clip 20 preferably comprises a pair of opposing slightly elastic arm members 24A, 24B or elastic straps that extend downward from the bottom side 12 of the base member 10. As shown most clearly in FIG. 4, the arm members 24A, 24B form an opening 22 for receiving the first electrical cord 80. As shown in FIG. 4, the lower end 26A, 26B each arm member 24A, 24B converges toward the lower end 26A, 26B of the opposing arm member 24A, 24B. The inwardly turned lower ends 26A, 26B of the arm members 24A, 24B are spaced apart from one another at least slightly less than the diameter of standard extension cords, such that a retaining force is preserved when the first electrical cord 80 is slipped into the opening 22 of the clip 20. Of course, when the device is used on irregularly sized cords, or on electrical cords that are not circular in cross-section, it is necessary to size and configure the clip 20 accordingly, or the use of a tie wrap or similar device made a part of the connector, the main objective being to provide a clip 20 that can be readily secured to a first electrical cord 80, that will not separate from the cord 80 during ordinary use, and that can be readily removed from the electrical cord 80 as needed. These objectives can be achieved by forming or molding the clip 20 of conventional plastics, metals or like materials having a sufficient ratio of elasticity to stiffness. In a preferred embodiment shown in FIG. 4, each arm member 24A, 24B is substantially semicircular, such that an inner side of each arm member 24A, 24B abuts against an outer surface of the first electrical cord 80 to thereby prevent the device from sliding along the first electrical cord 80. As shown in FIG. 5, the clip 20 is preferably substantially centrally disposed on the bottom side 12 of the base member 10. The clip 20 may extend any length along the base member 10, including the entire length of base member 10, in order to increase holding power.

FIG. 4 shows a preferred embodiment in which the clip 20 is located directly below the hook member 40, i.e. at about 180 degrees on the opposite side of the base member 10. In alternative embodiments, the clip 20 can be placed in various positions relative to the longitudinal axis of the base member 10, the primary constraint being that the clip 20 not interfere with the securing of the second cord 90 on the eyelet member 30 and hook member 40. Accordingly, the term "bottom" as used in the claims should be interpreted broadly to include any position of the clip 20 on the base member 10 in which the clip 20 does not interfere with securing the second cord 90 on the eyelet member 30 and hook member 40.

Figure 3:
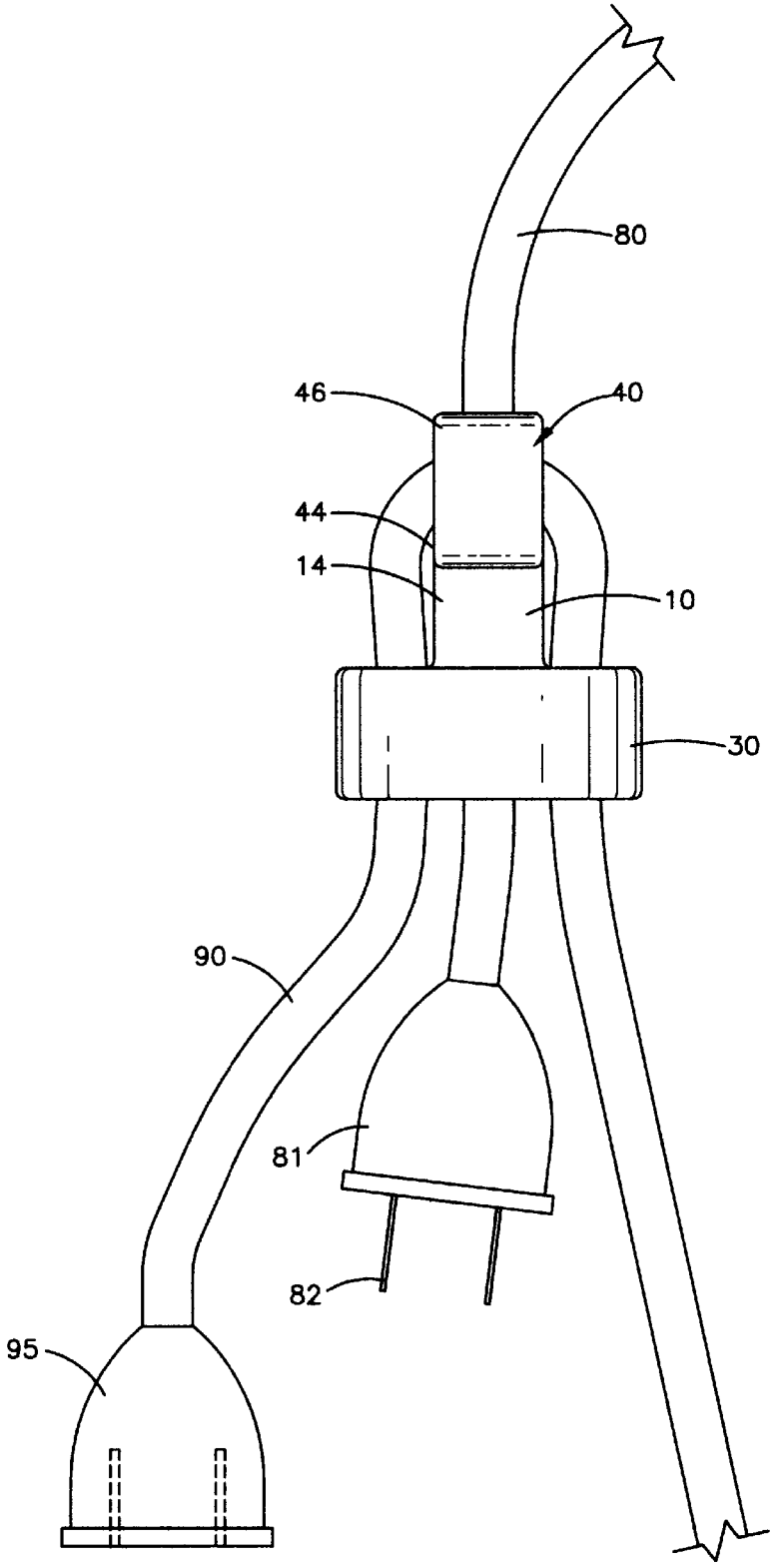
FIG. 3 is top view of one preferred embodiment of the invention showing a pair of electrical cords in an unplugged condition.

The eyelet 30 is on the top side 14 of the base member 10 closer to the front end 16 than the rear end 18. The eyelet is preferably on or adjacent the front end 16 of the base member. The eyelet 30 defines an opening 32, as shown most clearly in FIG. 4. The opening 32 of the eyelet 30 is sized to receive a loop of a second electrical cord, as shown in FIGS. 2 and 3. The eyelet 30 can be of various dimensions and shapes. In order to avoid damage to the outer insulated coating of the electrical cords, the eyelet 30 preferably has rounded contours and edges. Because one of the objectives of the invention is to provide a device that is smaller and more compact than the prior art, the eyelet 30 is preferably just wide enough to allow ready insertion and removal of the loop of an electrical cord.

The hook member 40 is positioned on the top side 14 of the base member 10 closer to the rear end 18 than the front end 16. The hook member 40 can be of various dimensions and shapes, provided that the hook member 40 is configured to receive the loop of the second electrical cord and secure the second electrical cord on the base member 10. In a preferred embodiment shown most clearly in FIG. 5, the hook member 40 preferably comprises an upward extension 44 extending upward from the top side 14 of the base member 10, and a rearward extension 46 extending toward the rear end of the base member 10. Together, the top side 14 of the base member 10, the upward extension 44, and the rearward extension 46 define an opening 42 in the hook member 40 for receiving the second electrical cord 90. The hook member 40 can be configured such that the rearward extension 46 holds the loop of the second electrical cord 90 tightly against the top side 14 of the base member, to thereby assist in securing the second electrical cord 90 on the device 1. The upward extension 44 is spaced apart from the eyelet member 30 a sufficient distance to allow the loop of the second electrical cord 90 to be slipped over the hook 40 member.

The device 1 is preferably molded from one piece of plastic, preferably of the thermoplastic variety. Preferred types of plastic include polyvinyl chlorides (PVC), nylons and the like. The composition of the plastic can be varied to produce a desired degree of elasticity, flimsiness, and rigidity. When constructed of durable thermoplastic or similar materials, the device 1 is not easily broken, bent, disfigured, or damaged.

As shown in FIGS. 2 and 3, the device of the invention 1 is used with conventional electric cords. The first electrical cord 80 may be either a conventional electrical cord, or it may be an electrical cord that is built into and extends from the body of a tool. The first electrical cord 80 has a conventional male plug 81 on one end. The male plug has conventional conductor blades 82 which can be plugged into a wall outlet or a female plug 95, such as that of the second electrical cord 90. The second electrical cord 90 is a conventional electrical cord having a female plug 95 on one end and a male plug 91 on the other end, the male plug 91 having conventional blades 92 for plugging the cord into an electrical wall outlet or other source of electricity. With the first and second cords 80, 90 plugged together and secured by the device 1 in the manner shown in FIGS. 2 and 3, it is difficult or impossible for the electrical cords to become separated from one another during use of an electric tool.

The foregoing design is smaller and more compact than existing devices, and therefore easier to package and store, less likely to be damaged, and less expensive to manufacture. The base member 10 may be less than three inches in length between the front 16 and rear ends 18, which allows the device 1 to be used on short pigtail cords, including cords of less than 2 inches in length. The base member 10 is preferably less than two inches in length. The small size of the device 1 encourages users of the device to store the device on an electrical cord, which decreases the chances of losing the device. The device 1 also minimizes bending and kinking of electrical cords, which avoids damage to the outer insulation of cords. It should also be noted that although the device of the invention 1 is intended primarily for use on electrical cords, it may be used in virtually any situation in which two flexible cords are attached together, including for example coaxial cables.

In operation, the cord-to-cord restraining device of the invention 1 is used by securing the device 1 onto an end 81 (preferably a male end) of a first electrical cord 80 via the clip 20, plugging the end 81 of the first electrical cord into an end 95 (preferably a female end) of a second electrical cord 90 to thereby establish electrical connection between the first and second electrical cords 80, 90, bending the second electrical cord 90 adjacent the end 95 of the second electrical cord 90 to thereby form a loop in the second electrical cord 90, inserting the loop through the opening 32 of the eyelet 30, passing the loop over the hook 40, and pulling the second electrical cord 90 to tighten the loop against the 40 hook and thereby prevent the second electrical cord 90 from separating from the device 1 and from the first electrical cord 80. The exact order in which the foregoing steps are performed will vary depending on the desires and convenience of the operator. For example, the second electrical cord 90 could be attached to the eyelet member 30 and hook member 40 before the first electrical cord 80 is attached to the clip 20. Likewise, the cords 80, 90 may be plugged together after the cords 80, 90 have been attached to the device, provided that it may be necessary to further tighten the second electrical cord 90 on the device once the electrical connection has been made. As shown in FIG. 3, the electrical plugs 81, 95 can be disconnected while clipped to the device 1.

Additionally, after an operator has completed use of the device and is prepared to unplug the electrical cords, the operator may desire to leave the device 1 attached to one of the cords for future use in maintaining the electrical cord in plugged together electrical connection with another electrical cord. The device may be left attached to either the clip 20 or the eyelet 30 and hook 40 members, depending on the preference of the operator. As mentioned above, storing the device 1 on an electrical cord decreases the chance that the device will become lost.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A cord-to-cord restraining device for maintaining electrical cords in plugged together electrical connection, the device comprising:

a base member, said base member having a front end, a rear end, a top side, and a bottom side;

a clip on said bottom side of said base member, said clip configured to engage and secure said device on a first electrical cord;

an eyelet on said top side of said base member closer to said front end than said rear end, said eyelet defining an opening sized to receive a loop of a second electrical cord; and a hook member on said top side of said base member closer to said rear end than said front end, said hook member configured to receive said loop of said second electrical cord and secure said second electrical cord on said base member.

2. The device of claim 1, wherein said clip is substantially centrally disposed on said bottom side of said base member.

3. The device of claim 1, wherein said hook member comprises an upward extension extending upward from said top side of said base member, and a rearward extension extending toward said rear end of said base member.

4. The device of claim 1, wherein said device is molded as one piece from plastic.

5. The device of claim 1, wherein said base member is less than three inches in length between said front and rear ends.

6. The device of claim 1, wherein said clip comprises a pair of opposing elastic arm members extending downward from said bottom side of said base member.

7. The device of claim 6, wherein a lower end of each said arm member converges toward said lower end of said opposing arm member, said lower ends of said arm members being spaced apart from one another a distance less than a diameter of said first electrical cord.

8. The device of claim 7, wherein each said arm member is substantially semicircular, such that an inner side of each said arm member abuts against an outer surface of said first electrical cord to thereby prevent said device from sliding along said first electrical cord.

9. A method of retaining electrical cords in plugged together electrical connection, comprising:

(a) providing a cord-to-cord restraining device for maintaining electrical cords in plugged together electrical connection, the device comprising: (i) a base member, said base member having a front end, a rear end, a top side, and a bottom side; (ii) a clip on said bottom side of said base member, said clip configured to engage and secure said device on an electrical cord; (iii) an eyelet on said top side of said base member closer to said front end than said rear end, said eyelet defining an opening sized to receive a loop of an electrical cord; and (iv) a hook member on said top side of said base member closer to said rear end than said front end, said hook member configured to receive said loop;

(b) securing said device onto an end of a first electrical cord via said clip;

(c) plugging said first and second electrical cords together to thereby establish electrical connection between said first and second electrical cords;

(d) bending said second electrical cord to thereby form a loop in said second electrical cord;

(e) inserting said loop through said eyelet;

(f) passing said loop over said hook; and (g) pulling said second electrical cord to tighten said loop against said hook and thereby prevent said second electrical cord from separating from said device and from said first electrical cord.

10. The method of claim 9, further comprising the steps of:

(h) unplugging said first and second electrical cords from one another;

(i) disengaging either said first or said second electrical cord from said device; and (j) retaining said remaining first or second electrical cord on said device for future use in maintaining said remaining electrical cord in plugged together electrical connection with another electrical cord.

11. The method of claim 9, wherein steps (d), (e), and (f) are performed before step (c).

12. The method of claim 11, further comprising the steps of:

(h) unplugging said first and second electrical cords from one another;

(i) disengaging either said first or said second electrical cord from said device; and (j) retaining said remaining first or second electrical cord on said device for future use in maintaining said remaining electrical cord in plugged together electrical connection with another electrical cord.

13. The method of claim 9, wherein steps (d), (e), and (f) are performed before step (b).

14. The method of claim 11, further comprising the steps of:

(h) unplugging said first and second electrical cords from one another;

(i) disengaging either said first or said second electrical cord from said device; and (j) retaining said remaining first or second electrical cord on said device for future use in maintaining said remaining electrical cord in plugged together electrical connection with another electrical cord.

* * * * *